US011751000B2

(12) United States Patent
Bahu et al.

(10) Patent No.: US 11,751,000 B2
(45) Date of Patent: Sep. 5, 2023

(54) METHOD OF MODELING THE ACOUSTIC EFFECTS OF THE HUMAN HEAD

(71) Applicant: Google LLC, Mountain View, CA (US)

(72) Inventors: Hélène Bahu, San Francisco, CA (US); David E. Romblom, San Mateo, CA (US)

(73) Assignee: Google LLC, Mountain View, CA (US)

( * ) Notice: Subject to any disclaimer, the term of this patent is extended or adjusted under 35 U.S.C. 154(b) by 171 days.

(21) Appl. No.: 17/419,840

(22) PCT Filed: Jan. 31, 2020

(86) PCT No.: PCT/US2020/016017
§ 371 (c)(1),
(2) Date: Jun. 30, 2021

(87) PCT Pub. No.: WO2020/180431
PCT Pub. Date: Sep. 10, 2020

(65) Prior Publication Data

US 2022/0086589 A1 Mar. 17, 2022

Related U.S. Application Data

(60) Provisional application No. 62/812,485, filed on Mar. 1, 2019.

(51) Int. Cl.
*H04S 7/00* (2006.01)
*H04R 5/027* (2006.01)

(52) U.S. Cl.
CPC ..... *H04S 7/304* (2013.01); *H04R 5/027* (2013.01); *H04S 2420/01* (2013.01)

(58) Field of Classification Search
CPC ..... H04S 7/304; H04S 2420/01; H04R 5/027
(Continued)

(56) References Cited

U.S. PATENT DOCUMENTS

2017/0078821 A1 3/2017 Faller et al.
2017/0094440 A1* 3/2017 Brown ..... H04S 7/30
(Continued)

FOREIGN PATENT DOCUMENTS

CN 101167086 A 4/2008

OTHER PUBLICATIONS

International Search Report and Written Opinion for International Application No. PCT/US2020/016017 dated Apr. 22, 2020. 6 pages.
(Continued)

*Primary Examiner* — Paul Kim
(74) *Attorney, Agent, or Firm* — Kilpatrick Townsend & Stockton LLP

(57) ABSTRACT

A method of modeling the human head is provided. The human head model has a width and an aspect ratio. The aspect ratio defines different head shapes independent of the size of the human head model. The method includes the steps of forming a high-frequency head model based on ray-tracing and a plurality of half plane sections, coupling the high-frequency head model with a far-field shadowing filter, coupling the far-field shadowing filter with a near-field compensation filter to compensate for acoustic changes between the far-field and near-field regions and modifying the aspect ratio of the human head model to configure variable geometric models of the human head ranging from a nearly spherical to a very narrow embodiment.

20 Claims, 12 Drawing Sheets

(58) Field of Classification Search
USPC ..... 381/74
See application file for complete search history.

(56) References Cited

U.S. PATENT DOCUMENTS

| | | | |
|---|---|---|---|
| 2017/0332186 | A1 | 11/2017 | Riggs et al. |
| 2018/0359568 | A1 | 12/2018 | Lyren et al. |

OTHER PUBLICATIONS

Röber et al. HRTF Simulations through Acoustic Raytracing. 2006. Retrieved from the Internet: <https://www.semanticscholar.org/paper/HRTF-SIMULATIONS-THROUGH-ACOUSTIC-RAYTRACING-R%CC%88ober-Andr%C3%A8s/c8ed0cbb96b17e733ff9clb65d24aa2ec5b6d1fd>. Retrieved on May 21, 2021. 4 pages.

International Preliminary Report on Patentability for International Application No. PCT/US2020/016017 dated Sep. 16, 2021. 6 pages.

* cited by examiner

METHOD OF MODELING THE ACOUSTIC EFFECTS OF THE HUMAN HEAD

RELATED APPLICATIONS

This application is a national phase entry under 35 U.S.C. § 371 of International Application No. PCT/US2020/016017, filed Jan. 31, 2020, which claims the benefit of U.S. Provisional Patent Application No. 62/812,485, filed Mar. 1, 2019, the entire disclosures of which are incorporated herein by reference.

BACKGROUND

Head related transfer functions (hereafter "HRTFs") are measurements of an acoustic wave's interaction with the human body when propagating from a sound source to the human ear. Non-limiting examples of this interaction include the acoustic shadowing of the head, the reflection of sound off the shoulders, or the resonances and notches caused by the pinna of the outer portion of an ear.

HRTFs can vary with the direction of the sound source, the distance from the sound source, the frequency of the sound source and morphology of the listener. HRTFs can be used in virtual auditory environments to spatialize sound sources over headphones.

Conventionally measured HRTFs may be considered a "black box" containing all constituent acoustic processes linked with different body parts. In other instances, structural models of HRTFs attempt to decompose these acoustic processes and model them separately using digital filters and delays. The structural models can be used to synthesize a listener's HRTFs when measurements are not available.

The acoustic effects of the human head can include delay of the arrival time and shadow of the sound wave at the contralateral ear, thereby creating interaural time differences (hereafter "ITD") and interaural level differences (hereafter "ILD"). The quantities of the ITD and ILD can vary with the direction, distance and frequency of the sound source, as well as with the size and shape of the human head. As one non-limiting portion of the structural models of HRTFs, the modeling of the human head aims at accurately estimating the quantities of the ITD and ILD with respect to the position and frequency of the sound source and the morphology of the human head.

It would be advantageous if methods of modeling the acoustic effects of the human head could be improved.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the methods of modeling the acoustic effects of the human head.

The above objects as well as other objects not specifically enumerated are achieved by a method of modeling the human head. The human head model has a width and an aspect ratio. The aspect ratio defines different head shapes independent of the size of the human head model. The method includes the steps of forming a high-frequency head model based on ray-tracing and a plurality of half-plane sections, coupling the high-frequency head model with a far-field shadowing filter, coupling the far-field shadowing filter with a near-field compensation filter to compensate for acoustic changes between the far-field and near-field regions and modifying the aspect ratio of the human head model to configure variable geometric models of the human head ranging from a nearly spherical to a very narrow embodiment.

The above objects as well as other objects not specifically enumerated are also achieved by a method of modeling the human head. The human head model has a width and an aspect ratio. The aspect ratio defines different head shapes independent of the size of the human head model. The method includes the steps of forming a high-frequency head model based on ray-tracing and a plurality of half-plane sections, coupling the high-frequency head model with a far-field shadowing filter and coupling the far-field shadowing filter with a near-field compensation filter to compensate for acoustic changes between the far-field and near-field regions. The width of the model of the human head corresponds to an anthropometric width of the human head.

Various objects and advantages of the methods of modeling the acoustic effects of the human head will become apparent to those skilled in the art from the following detailed description, when read in light of the accompanying drawings.

DETAILED DESCRIPTION

The methods of modeling the acoustic effects of the human head will now be described with occasional reference to specific embodiments. The methods of modeling the acoustic effects of the human head may, however, be embodied in different forms and should not be construed as limited to the embodiments set forth herein. Rather, these embodiments are provided so that this disclosure will be thorough and complete, and will fully convey the scope of the methods of modeling the acoustic effects of the human head to those skilled in the art.

Unless otherwise defined, all technical and scientific terms used herein have the same meaning as commonly understood by one of ordinary skill in the art to which the methods of modeling the acoustic effects of the human head belongs. The terminology used in the description of the methods of modeling the acoustic effects of the human head herein is for describing particular embodiments only and is not intended to be limiting of the methods of modeling the acoustic effects of the human head. As used in the description of the methods of methods of modeling the acoustic effects of the human head and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the methods of modeling the acoustic effects of the human head. Notwithstanding that the numerical ranges and parameters setting forth the broad scope of the methods of modeling the acoustic effects of the human head are approximations, the numerical values set forth in the specific examples are reported as precisely as possible. Any numerical values, however, inherently contain certain errors necessarily resulting from error found in their respective measurements.

Figure 1:
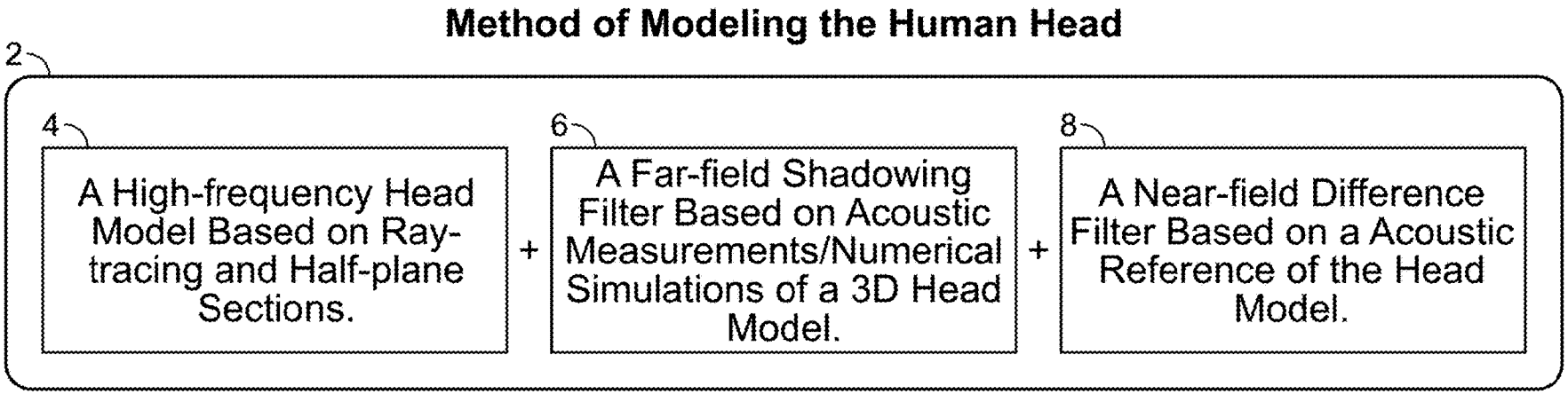
FIG. 1 is a chart illustrating elements used in a method of modeling the human head.

Referring now to FIG. 1, the description and figures disclose novel methods of modeling the acoustic effects of the human head 2 for use in delivering binaural signals to human ears. Generally, the novel methods of modeling the acoustic effects of the human head 2 incorporate three discrete elements: 1) a high-frequency head model 4 based on ray-tracing and half-plane sections (hereafter "high-frequency model"), 2) a far-field shadowing filter 6 based on acoustic measurements of a three-dimensional (hereafter "3D") head model or numerical simulations of the 3D head model (hereafter "acoustic reference of the head model") and 3) a near-field compensation filter 8 based on acoustic reference of the head model and configured to compensate for acoustic changes between the far-field and the near-field regions. The term "far-field region", as used herein, is defined to mean a source positioned a distance of one meter or more from a center of the head model. The term "near-field region", as used herein, is defined to mean a source positioned a distance of less than one meter from a center of the head model.

Referring again to FIG. 1 and concerning the high-frequency head model 4, conventional ray-tracing methods assume that a geometric path to the ear amounts to the time of arrival of an acoustic wave to the same ear. Conventional head modeling methods based on ray-tracing can employ simple shapes such as the sphere or an ellipsoid. It has been determined that such methods are valid above approximately 2 kHz for objects the size of the human head and can be used to predict the high-frequency interaural time differences (ITD).

Referring again to FIG. 1, in other conventional head modeling methods, the geometry of the spherical and ellipsoidal head models were optimized to fit the high-frequency interaural time difference (ITD) of acoustic measurements. It was shown that the spherical model best fit acoustic measurements when displaced backwards and upwards of the interaural axis. This results in a discrepancy between the measurement reference (the interaural axis) and the model origin. Similar performance was obtained from the ellipsoidal head model. While the ellipsoidal head model has only been defined as a high-frequency model, the spherical head model incorporates the three discrete elements described above. However, the spherical head model does not sufficiently approximate the human head shape. Accordingly, the spherical head model does not accurately model the ITD of the human head and the resulting dimensions cannot be easily related to anthropomorphic human head dimensions.

Figure 2:
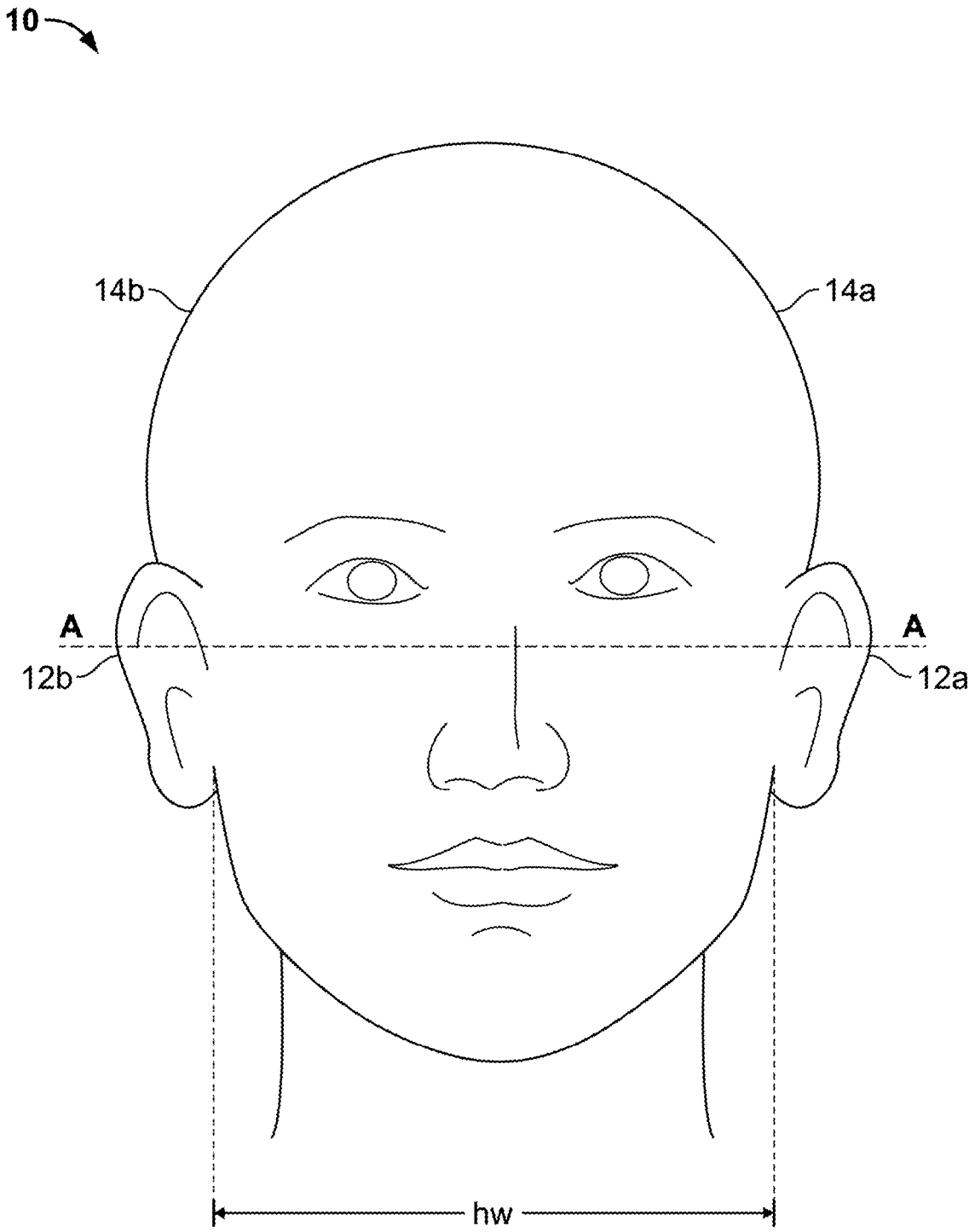
FIG. 2 is a front view of a geometric model of the human head.

Referring now to FIG. 2, a geometric model of the human head 10 is illustrated. The geometric model of the human head 10 can be used to predict the high-frequency time of arrival to a single ear. The geometric model of the human head 10 includes left and right entrances to the ear canals 12*a*, 12*b*, each positioned on opposing left and right sides 14*a*, 14*b* of the head. The geometric model of the human head 10 includes an interaural axis A-A. The term "interaural axis", as used herein, is defined as an axis extending between the left and right entrances to the ear canals 12*a*, 12*b*.

Figure 3A:
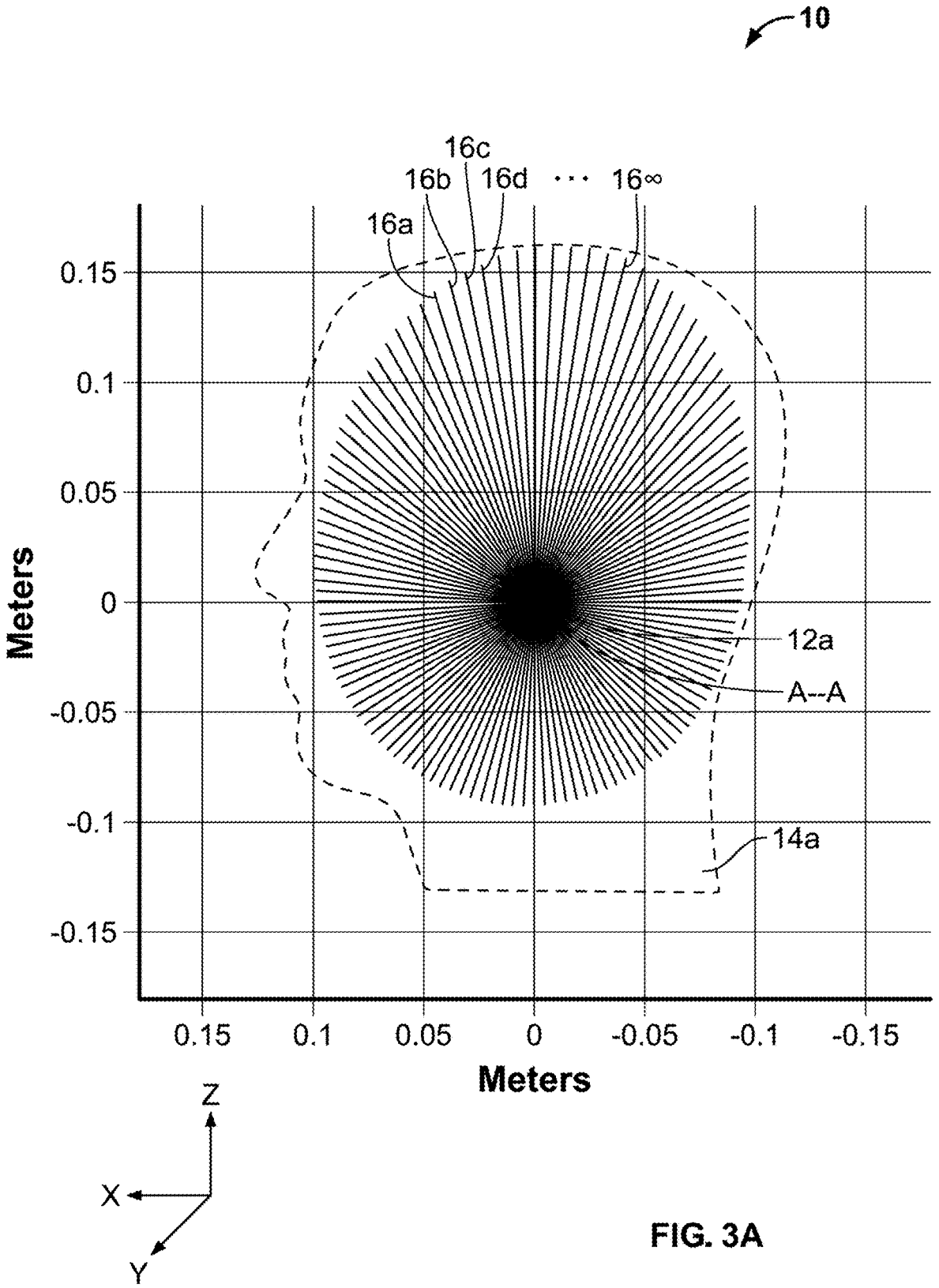
FIG. 3A is a chart illustrating a side view of the geometric model of the human head of FIG. 2 and a plurality of superimposed half-planes.

Referring now to FIG. 3A, the geometric model of the human head 10, entrance to ear canal 12*a* and interaural axis A-A are illustrated. In contrast to conventional spherical or ellipsoidal models, the geometric model of the human head 10 is sectioned into a desired plurality of half-planes 16*a*-16$_\infty$, with each of the half-planes 16*a*-16$_\infty$ extending from the interaural axis A-A in a radial direction. An accumulation of the half planes 16*a*-16$_\infty$ define the shape of the human head.

Figure 3B:
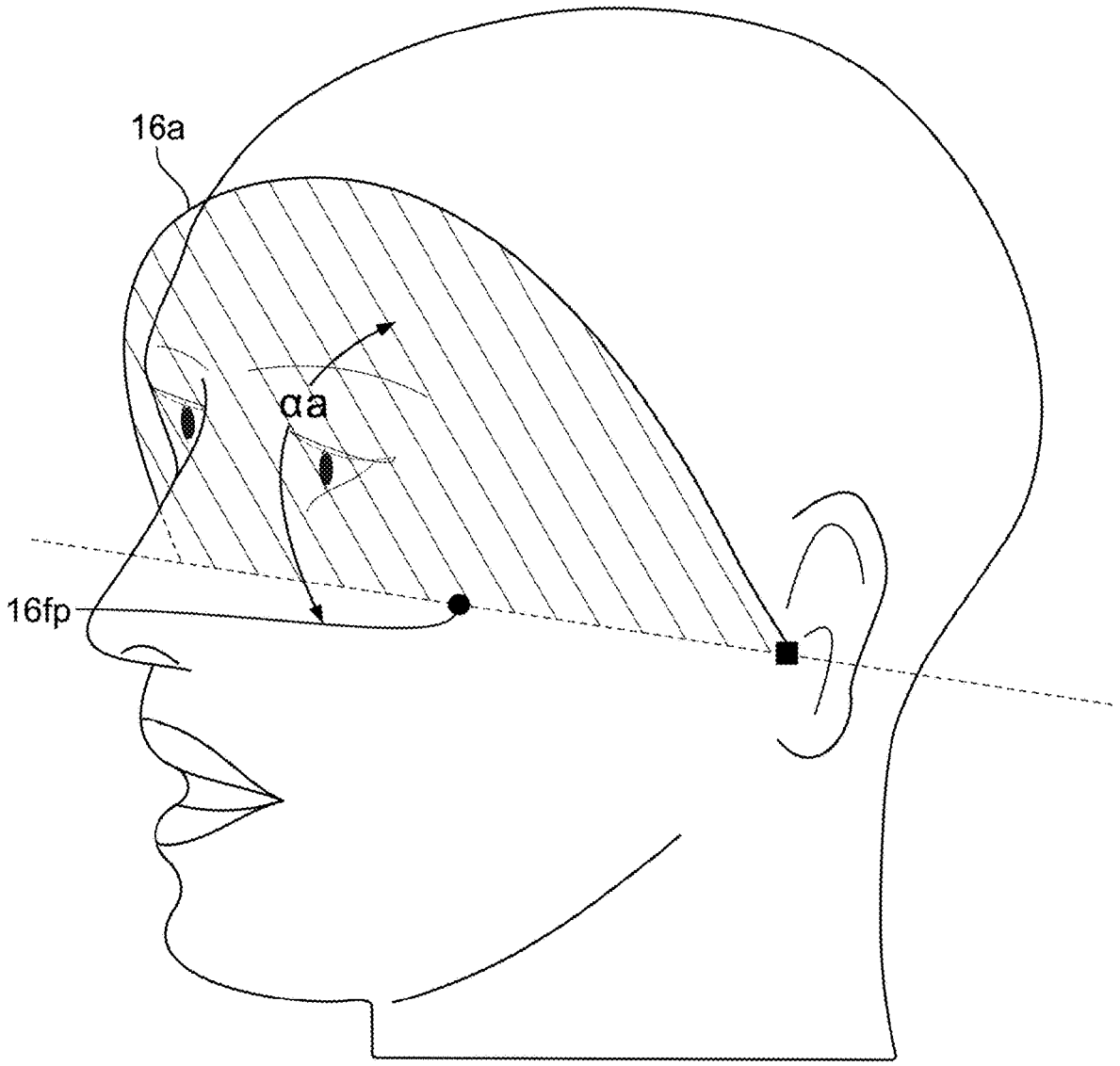
FIG. 3B is a perspective view of the geometric model of the human head of FIG. 2 illustrating a polar angle formed by a lone half-plane.

Referring now to FIG. 3B, each of the half-planes 16*a*-16$_\infty$ forms a different polar angle $\alpha$a-$\alpha_\infty$. The term "polar angle" as used herein, is defined as an angle formed between a half-plane and a frontal half plane 16$_{fp}$ oriented in the Y axis direction and extending radially from the interaural axis A-A.

Figure 3C:
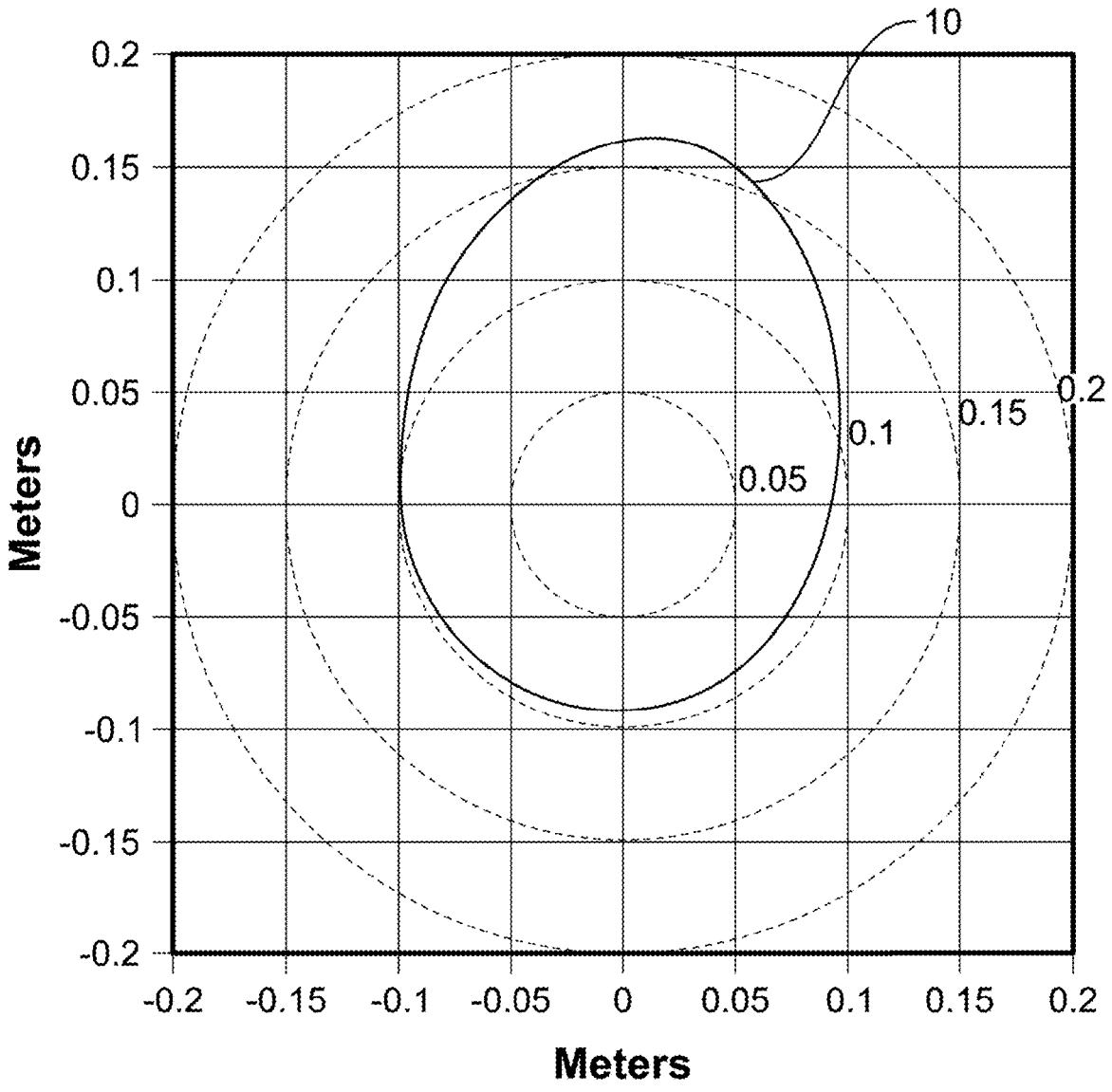
FIG. 3C is a chart illustrating the geometric model of the human head of FIG. 2 after consideration of interpolation, the geometric model having an ovular shape when viewed from a side.

Referring now to FIG. 3C, the resulting geometric model of the human head 10 is illustrated without the half-planes 16*a*-16$_\infty$ and after consideration of interpolation. The resulting geometric model of the human head has a generally ovular shape when viewed from a side.

Figure 4A:
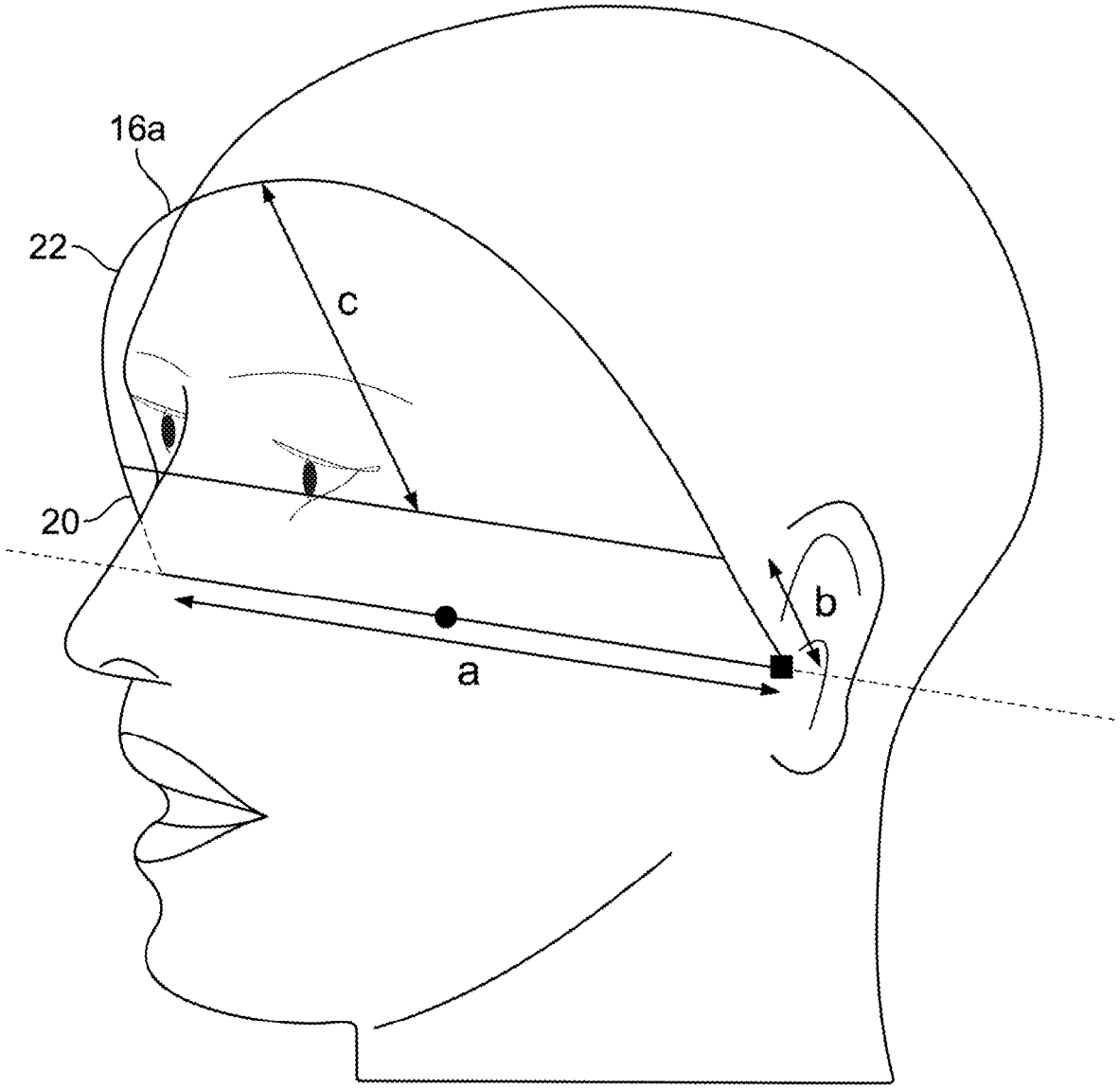
FIG. 4A is a perspective view of the geometric model of the human head of FIG. 3B illustrating a first embodiment of a half-plane 16*a* formed from a rectangular shape coupled with a semi-circular shape.
Figure 4B:
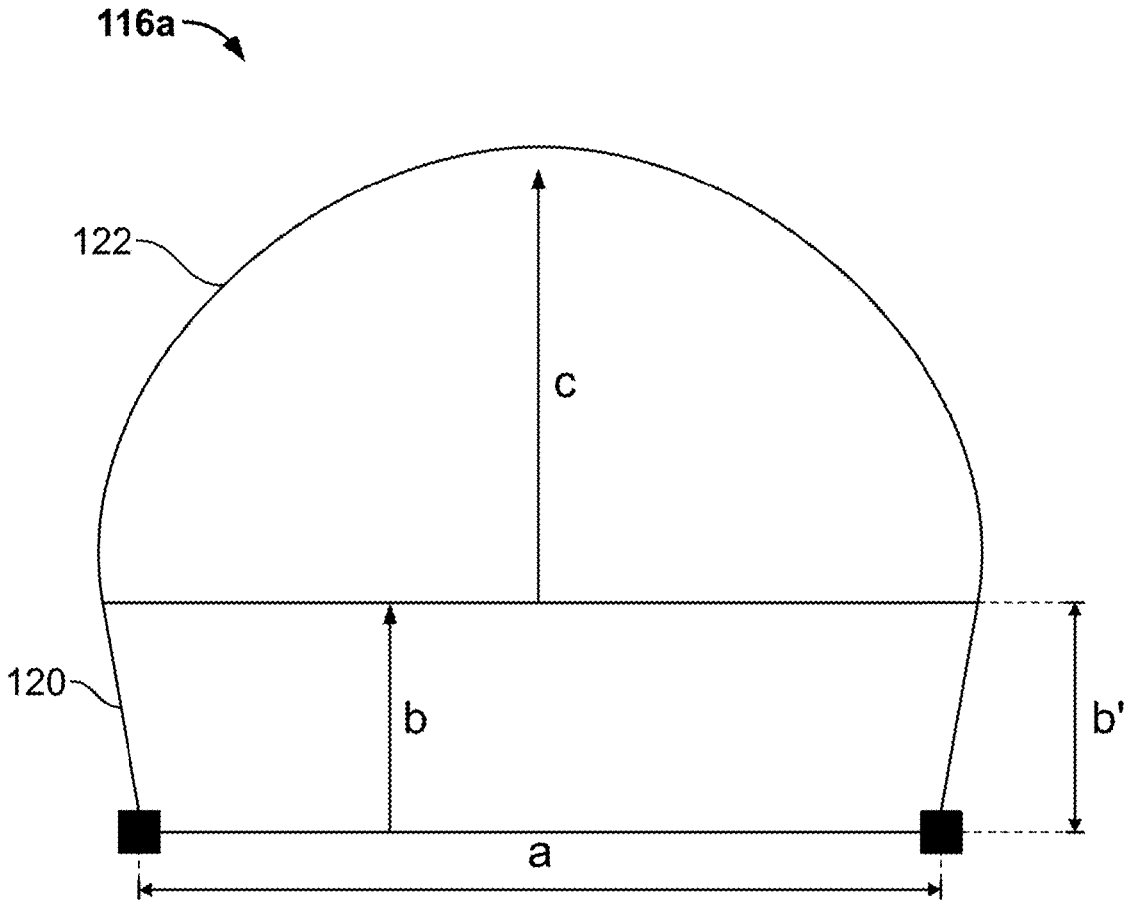
FIG. 4B is a front view of a second embodiment of a half-plane 16*a* formed from an isosceles trapezoidal shape coupled with a semi-circular shape.

Referring now to FIG. 4A, a first embodiment of a half plane 16*a* is illustrated. A time of arrival for the half-plane 16*a* is modeled using a rectangular shape 20 coupled with a semi-circular shape 22. The rectangular shape has a width a and a height b. The semi-circular shape 22 has a radius of c, where the radius c is equal to one-half (½) of the width a of the rectangle 20. In certain instances, the radius c can be larger than one-half (½) of the width a, in which case the rectangular shape 20 can have other shapes, such as the non-limiting example of an isosceles trapezoidal shape as shown in FIG. 4B and described below. It is intended that the combination of the dimensions for the width a, height b and radius c closely approximate anthropomorphic human head measurements. In the illustrated embodiment, the width a is in a range of from about 12.0 cm to about 17.0 cm, the height b is in a range of from about 0.0 cm to about 13.0 cm and the radius c is in a range of from about 6.0 cm to about 10 cm. However, in other embodiments, the width a can be less than about 12.0 cm or more than about 17.0 cm, the height b can be more than about 13.0 cm and the radius c can be less than about 6.0 cm or more than about 10.0 cm, sufficient that the resulting shape closely approximate anthropomorphic human head measurements.

Referring now to FIG. 4B, a second embodiment of a half plane 116*a* is illustrated. The half plane 116*a* is shaped differently than the half plane 16*a* shown in FIG. 4A. Without being held to the theory, it is believed the half plane 116*a* can be adapted to a particular head size and may better match the human head shape above and behind the ears. In this embodiment, the half-plane 116*a* is modeled using an isosceles trapezoidal shape 120 coupled with a semi-circular shape 122. The isosceles trapezoidal shape 120 has a base width a, a height b and a leg height b'. The base width a of the isosceles trapezoidal shape 120 is equal to the base width a of the rectangular shape 20, shown in FIG. 4A and described above. The semi-circular shape 122 has a radius of c, where the radius c is greater than one-half (½) of the base width a of the isosceles trapezoidal shape 120. It is intended that the combination of the dimensions for the base width a, height b, leg height b' and radius c closely approximate anthropomorphic human head measurements. In the illustrated embodiment, the leg height b' is in a range of from about 0.0 cm to about 13.0 cm. However, in other embodiments, the leg height b' can be more than about 13.0 cm, sufficient that the resulting shape closely approximate anthropomorphic human head measurements.

Referring again to FIG. 2, an anthropomorphic head width hw defines a width of the geometric model of the human head 10 as the length of the interaural axis between the left and right entrances to the ear canals 12*a*, 12*b*. It should be appreciated that the anthropomorphic head width hw does not include the pinnae.

Referring again to FIG. 3A, all of the half-planes 16*a*-16*f* have the same width, but different lengths. The term "length of a half-plane", as used herein, is defined to mean the sum of the rectangular or trapezoidal height b and the radius c of the half circle 22, 122. With the consideration of interpolation, the half-planes 16*a*-16$_\infty$ define the shape of the human head model. Independent of the width of the human head model, the aspect ratio of the human head model can be modified. The term "aspect ratio", as used herein, is defined as the ratio of the half-planes lengths to one-half of the width of the human head model. Modifying the aspect ratio of the human head model allows a configurable geometric model of the human head 10 ranging from a nearly spherical to a very narrow embodiment. The origin of the geometric model of the human head 10 is the halfway point between the entrances of the ear canals 12*a*, 12*b* on the interaural axis A-A leading to a reference consistent with acoustic measurements.

Particular attention was given to defining a geometric model of the human head 10 that corresponded to a physical shape. In an ideal case, this physical shape will correspond to the human head, and advantageously allows acoustic measurements or numeric simulations to be made for phenomenon not predicted by ray tracing. Non-limiting examples of such phenomena are low frequency phase characteristics, acoustic shadowing, and near field shadowing behavior.

Similar to conventional models, the present head model geometry is optimized to fit high-frequency ITD of acoustic measurements. For better consistency with measurements and to ensure that the resulting optimal shape resembles a human head, modifications to the predicted high-frequency time of arrival are introduced to account for three components that affect the propagation path: 1) the additional propagation path due to the presence of the pinna, 2) the multiple propagation paths around the head and 3) the additional human head width above and behind the ears.

Once the head model geometry has been defined, acoustic measurements and/or numeric simulations of the head model can be made for a plurality of source positions. The acoustic measurements and/or the numeric simulations can be repeated for a plurality of head model sizes, head model shapes, head model widths and head model aspect ratios, in a manner such that a continuum of heads can be sufficiently approximated. It is further contemplated that the head model can be adapted to a particular human head based on anthropomorphic human head measurements.

Referring again to FIGS. 1 and 3A and as discussed above, the high-frequency head model 4 is based on the half-planes 16*a*-16$_\infty$ and ray-tracing formula that predict the time of arrival at an ear with respect to the center of the head. The ray-tracing formula uses the equations:

$$\Delta T(\theta, a, b, b') = -\frac{a}{2 * Co} * \cos(\theta) \text{ if } 0 \le |\theta| < \frac{p}{2}$$

or $$\Delta T(\theta, a, b, b') = \frac{C}{Co} \times \left(\theta - \frac{\pi}{2}\right) + \frac{b'}{Co} - \frac{b}{Co} \times \cos\left(\theta - \frac{\pi}{2}\right) \text{ if } \frac{\pi}{2} \le |\theta| < \pi$$

where θ is an angle between the source and the ear with respect to the center of the head, a is the width of the rectangular or trapezoidal shape, b is the height of the rectangular or trapezoidal shape, b' is the leg height of the isosceles trapezoid, c is the radius of the half circle and Co is the sound celerity. In certain instances where the half-plane consists of a rectangle and a half-circle, then b' equals b.

Next, referring again to FIG. 1 and concerning the far-field shadowing filter 6 based on acoustic reference of the head model (hereafter "shadowing filter"), it has been found that conventional ray tracing formula for a rigid sphere can provide a pure delay that is accurate above approximately 2 kHz. To model the acoustic shadowing of the human head, as well as the increase in the low-frequency interaural time difference, conventional methods have defined a 1-pole 1-zero shadowing filter to augment conventional ray tracing formula. The 1-pole 1-zero shadowing filter is described by the following conventional equation:

$$H(s) = \frac{a\tau s + 1}{\tau s + 1}$$

$$\text{where } \tau = \frac{r}{aCo}$$

where r is a quantity varying with the size of the head.

Subsequent methods revised this work by comparing the filter characteristics to those known in the art (hereafter the "spherical Rayleigh approximation") and matched the shadowing characteristics, low frequency interaural time difference and spatial variation. In the proposed method, the identical 1-pole 1-zero filter design method is incorporated; however, the variability of a in respect to the position of the sound source is redefined to account for the shape of the novel model of the human head 10.

Next, concerning the near-field compensation filter 8 based on acoustic measurements of the head model (hereafter "near-field filter"), conventional methods defined a near-field model that compensated measured far-field HRTF. In later related work, methods were developed involving a 1-pole 1-zero approximation to these methods again using the spherical Rayleigh approximation. In these prior art instances, the spherical Rayleigh approximation is used to predict the near-field response as a virtual source approaches a rigid sphere. By comparing these spectral changes with the spectra at reference distance (1 m), a "difference filter" can be composed. Under the assumption that the changes for the human head are similar, these difference filters can be used to compensate measured HRTF.

The proposed near-field filter 8 is configured to account for the large changes in interaural level difference as a virtual source approaches the human head, especially at low frequencies and for lateralized sources. In a manner similar to the above far-field filter discussed above, the proposed near-field filter 8 is based on acoustic reference of the human head 10, as discussed above. The near-field filter 8 can be any desired and suitable configuration, as is known in the art.

Figure 5A:
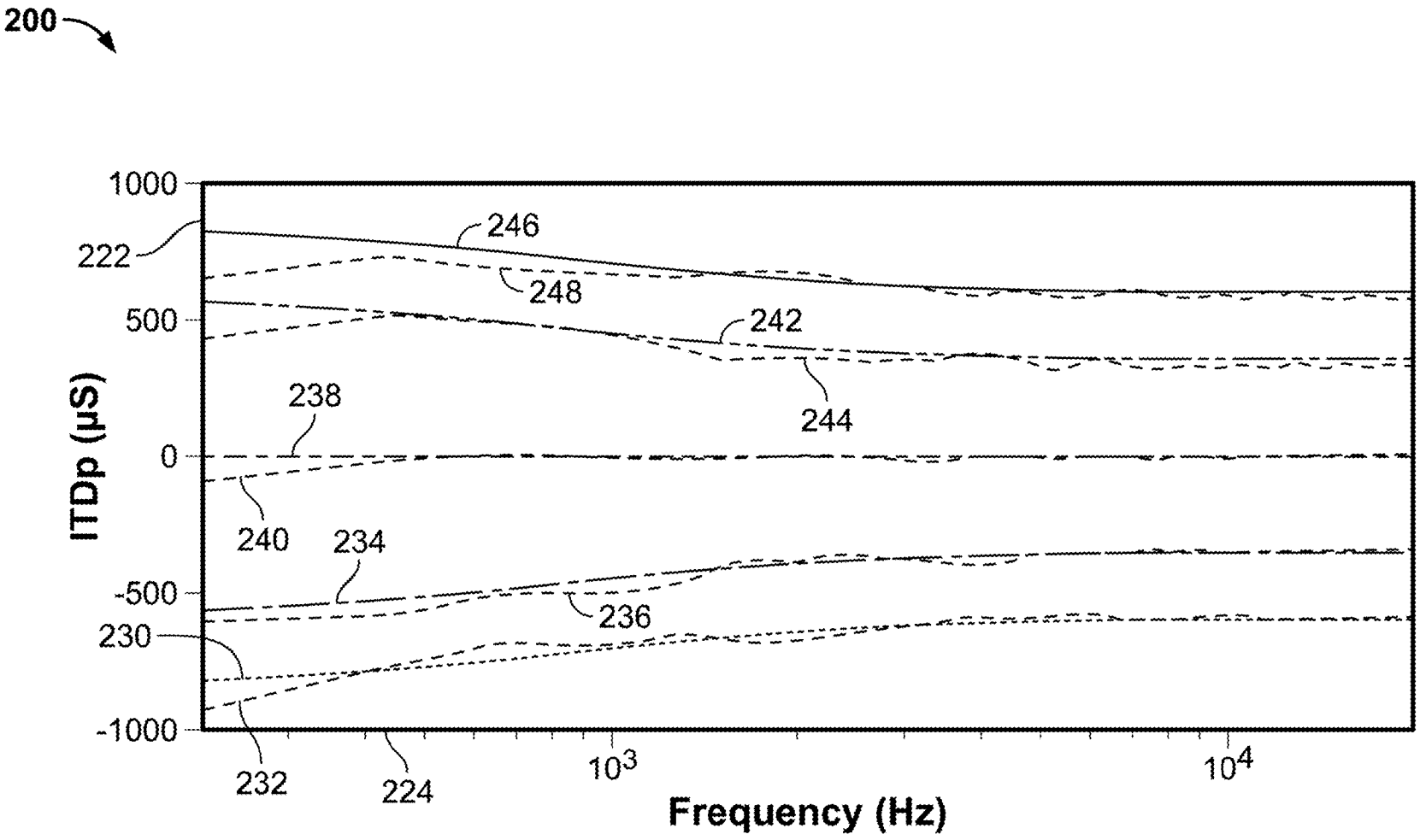
FIG. 5A is a color graph depicting model and measured values of interaural time differences (ITD) at varying frequencies.

The novel methods 2 of modeling the acoustic effects of the human head 2 for use in delivering binaural signals to human ears are intended to accurately estimate the quantities of the interaural time differences (ITD) and interaural level differences (ILD). Referring now to FIGS. 5A-5E, the results of the method 2 are illustrated. Referring first to FIG. 5A, a graph depicting the interaural time differences (ITD) at varying frequencies is presented at 200. The graph 200 of FIG. 5A has a vertical axis 222 of interaural time differences (in units of μs) and a horizontal axis 224 of Frequency (in units of Hz). A model interaural time difference 230 (ITD) is compared with a measured interaural time difference 232 (ITD) for a source position (az, el)=(−80.0). Similarly, a model interaural time difference 234 (ITD) is compared with a measured interaural time difference 236 (ITD) for a source position (az, el)=(−45.0). In a similar manner, a model interaural time difference 238 (ITD) is compared with a measured interaural time difference 240 (ITD) for a source position (az, el)=(0.0). Further, a model interaural time difference 242 (ITD) is compared with a measured interaural time difference 244 (ITD) for a source position (az, el)=(45.0). Finally, a model interaural time difference 246 (ITD) is compared with a measured interaural time difference 248 (ITD) for a source position (az, el)=(80.0). As clearly shown in FIG. 5A, the novel method of modeling the human head offers an accurate prediction of the interaural time differences in frequency as compared to acoustic measurements of a manikin head (without pinna and with a torso).

Figure 5B:
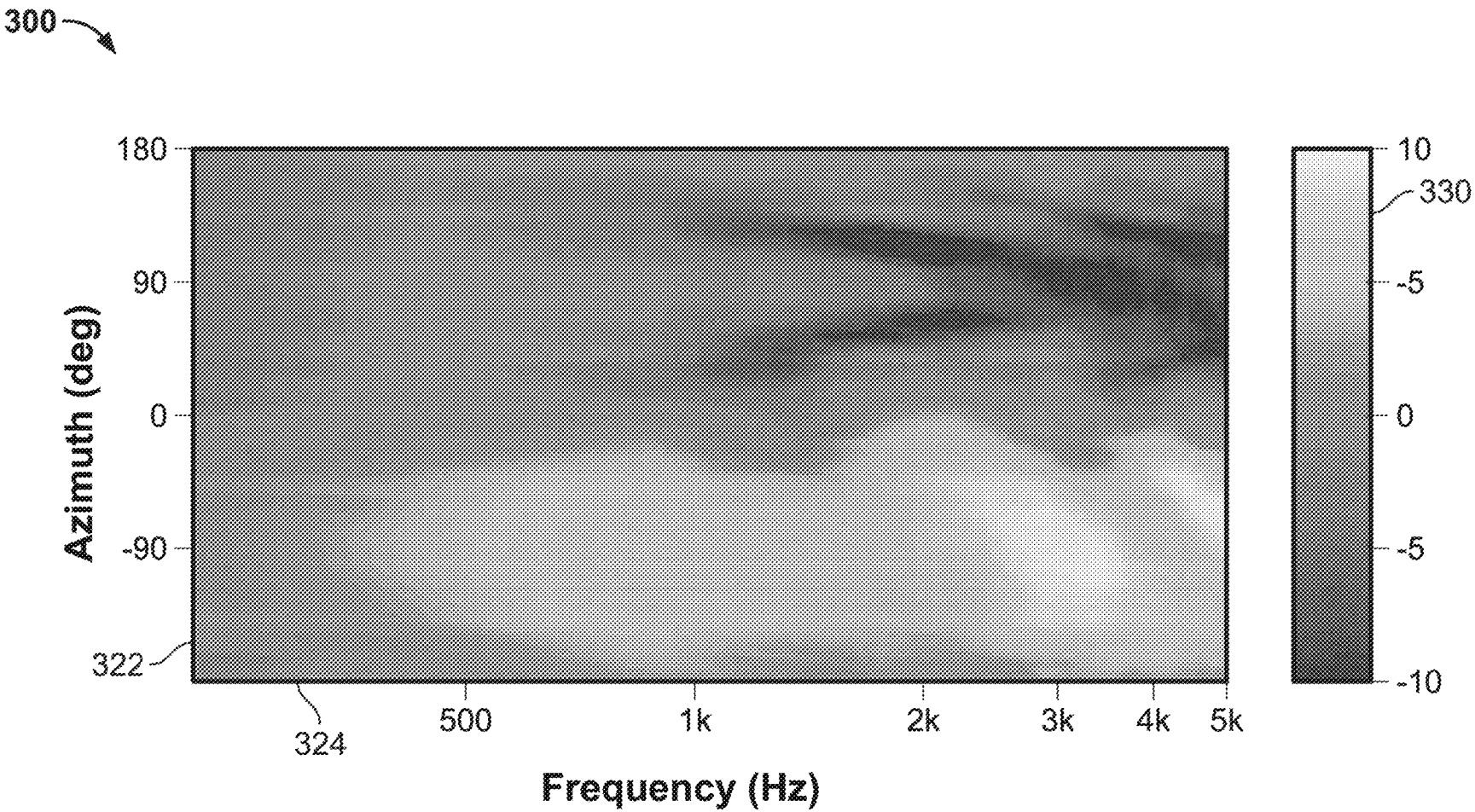
FIG. 5B is a color graph depicting the measured magnitude of the head related transfer function (HRTF) of a manikin head with a torso for different azimuths in a horizontal plane.

Referring now to FIG. 5B, a graph depicting the measured magnitude of the head related transfer function (HRTF) of a manikin head with a torso for different source azimuths in a horizontal plane (elevation 0.0 degrees) is presented at 300.

Figure 5C:
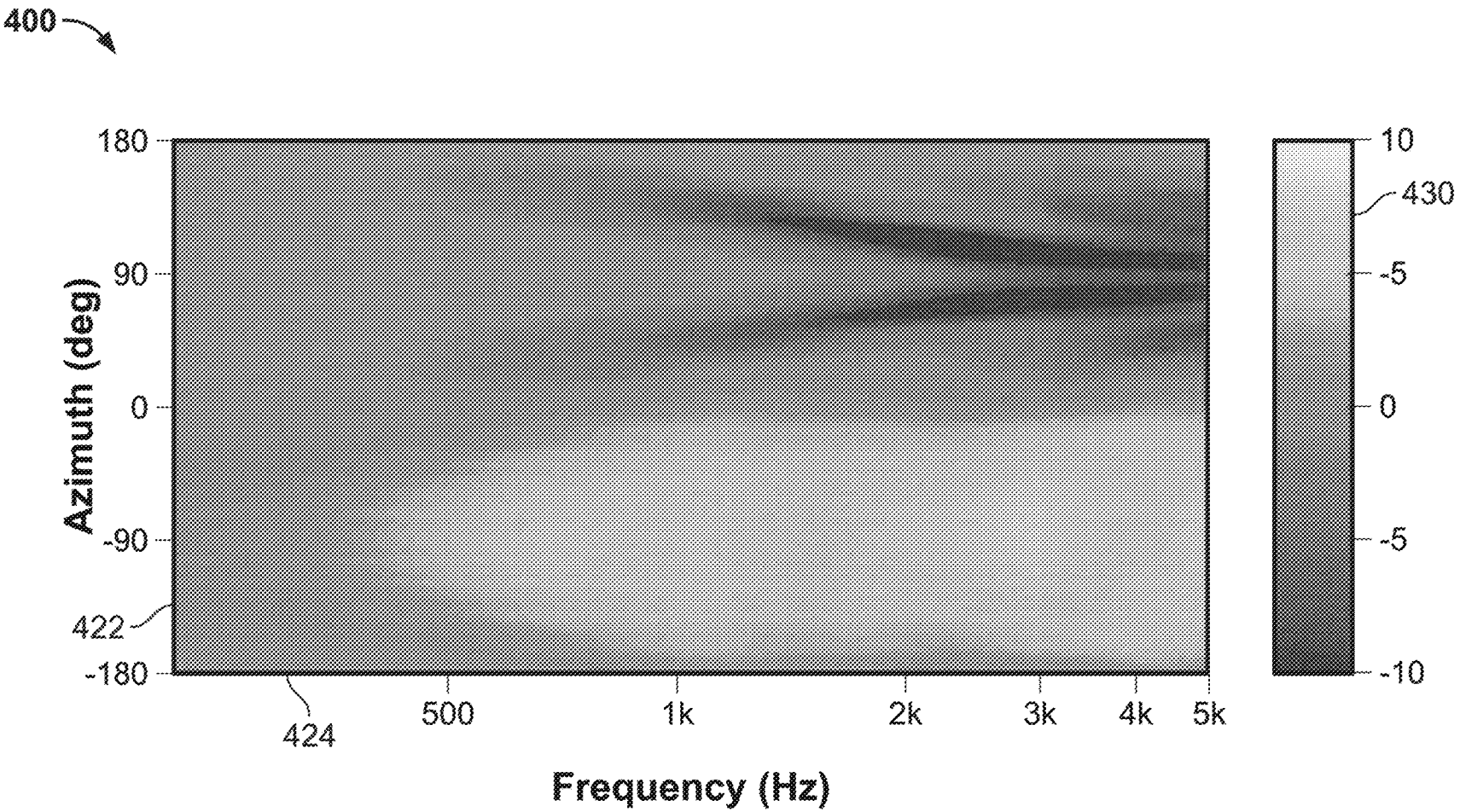
FIG. 5C is a color graph depicting the magnitude of the head related transfer function (HRTF) of the acoustic reference of the head model for different azimuths in a horizontal plane.

Referring now to FIG. 5C, a graph depicting the magnitude of the head related transfer function (HRTF) of the acoustic reference of the head model for different source azimuths in a horizontal plane (elevation 0.0 degrees) is presented at 400.

Figure 5D:
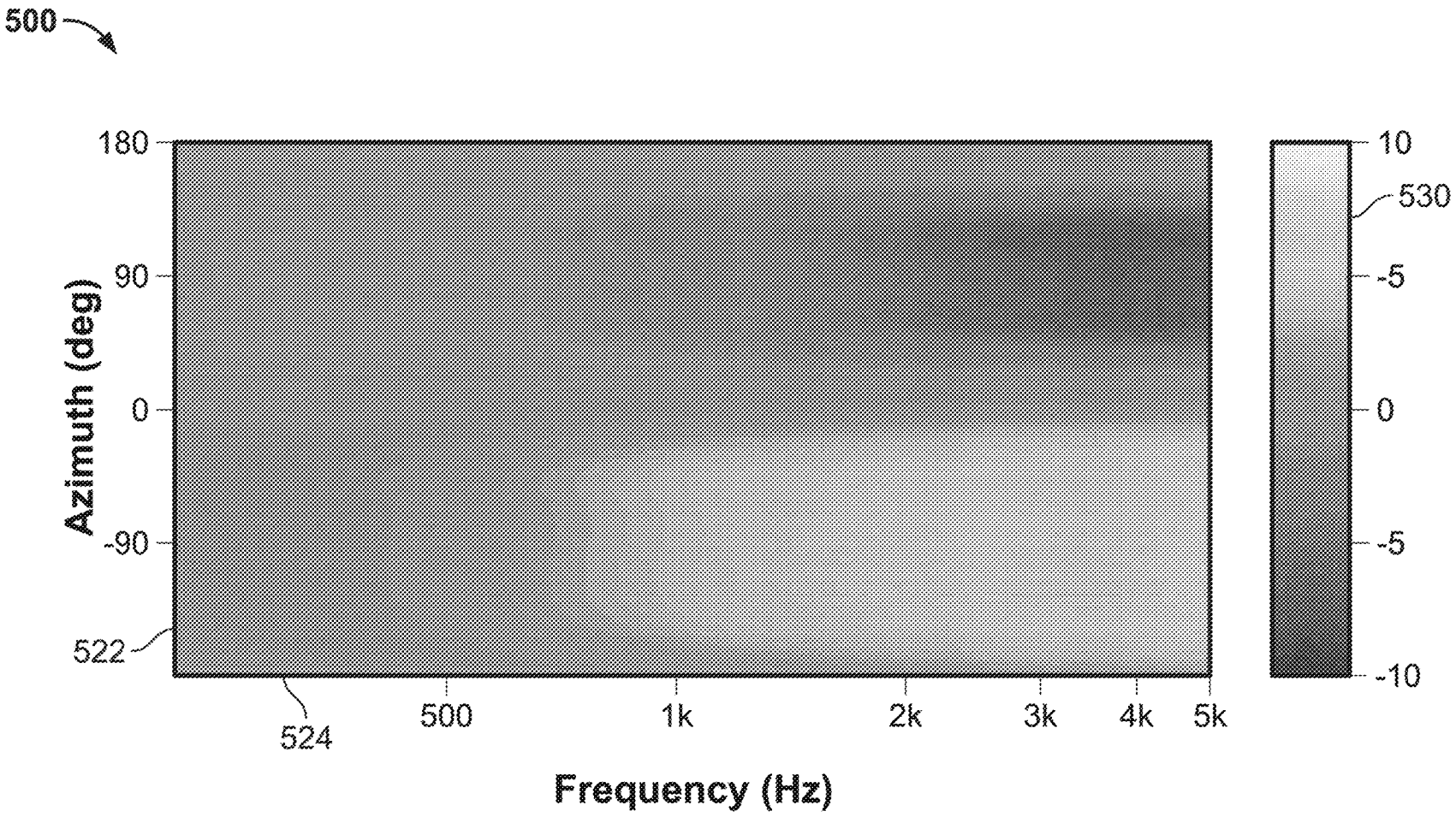
FIG. 5D is a color graph depicting the model magnitude of the head related transfer function (HRTF) for different azimuths in a horizontal plane.

Referring now to FIG. 5D, a graph depicting the model magnitude of the head related transfer function (HRTF) for different source azimuths in a horizontal plane (elevation 0.0 degrees) is presented at 500.

Referring now to FIGS. 5B, 5C and 5D, the graphs 300, 400 and 500 have a vertical axes 322, 422 and 522 respectively of source azimuth angle (in units of degrees) and horizontal axes 324, 424 and 524 respectively of Frequency (in units of Hz). The head related transfer function (HRTF) magnitude (in units of dB) corresponding to the colors illustrated in graphs 300, 400 and 500 are specified in the vertical bars 330, 430 and 530 positioned to the right of the graphs 300, 400 and 500.

As clearly shown in FIGS. 5B, 5C and 5D, the novel method of modeling the human head advantageously provides accurate predictions of the magnitude of the head related transfer functions (HRTFs) in frequency as compared to acoustic measurements of a manikin head without pinna and with a torso. Without being held to the theory, it is believed the discrepancies between the measurements illustrated in graph 300 and the acoustic reference of the model head as shown in graph 400 can be traced to ripples observed in the measurements due to the presence of the torso and reflections off the shoulders. Further without being held to the theory, it is believed the discrepancies between the graph 500 and the acoustic reference of the head model shown in graph 400 can be traced to the approximations made by the use of the 1-pole 1-zero shadowing filter.

Figure 5E:
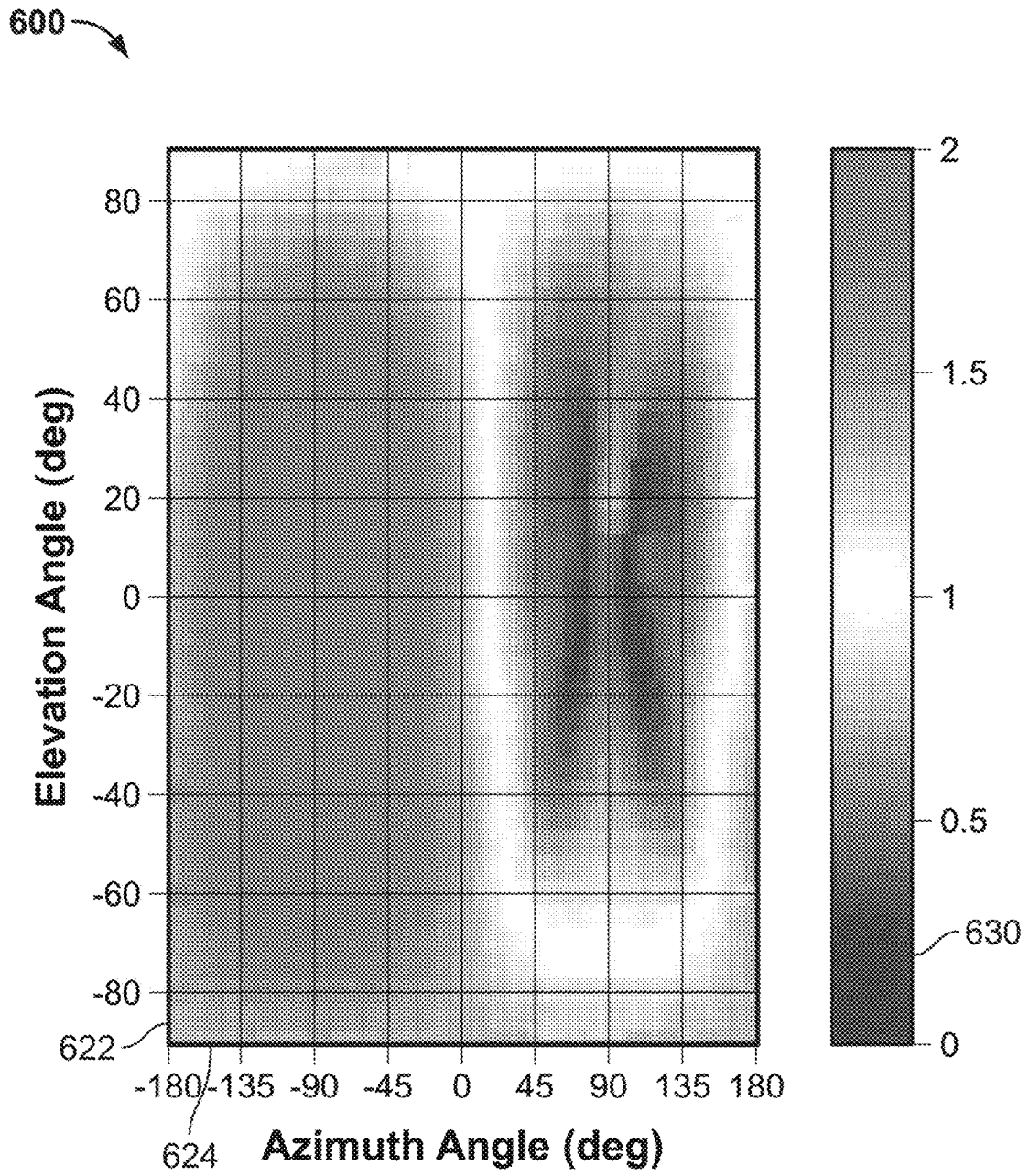
FIG. 5E is a color graph depicting the distribution of alpha as a function of elevation and azimuth angles.

Referring now to FIG. 5E, a graph depicting the distribution of alpha that account for the shape of the novel model of the human head is presented at 600, as a function of the position of the sound source (in azimuth and elevation). The graph 600 has a vertical axis 622 of source elevation angle (in units of degree) and a horizontal axis 624 of source azimuth angle (in units of degree). The alpha values (no units) corresponding to the colors presented graph 600 are specified in the vertical bar 630 to the right of graph 600."

The departure from the conventional methods are intended to advantageously capture the non-spherical properties of the human head. As such, the novel method more accurately model the human head and can be adapted to a particular human head based on anthropomorphic head measurements.

In accordance with the provisions of the patent statutes, the principle and mode of operation of the methods of modeling the acoustic effects of the human head have been explained and illustrated in certain embodiments. However, it must be understood that the methods of modeling the acoustic effects of the human head may be practiced otherwise than as specifically explained and illustrated without departing from its spirit or scope.

What is claimed is:

1. A method of modeling the human head, a human head model having a width and an aspect ratio, the aspect ratio defining different head shapes independent of a size of the human head model, the method comprising the steps of:

forming a high-frequency head model based on ray-tracing and a plurality of half-plane sections;

coupling the high-frequency head model with a far-field shadowing filter;

coupling the far-field shadowing filter with a near-field compensation filter to compensate for acoustic changes between the far-field and near-field regions; and modifying the aspect ratio of the human head model to configure variable geometric models of the human head ranging from a nearly spherical to a very narrow embodiment.

2. The method of claim 1, wherein the width of the model of the human head corresponds to an anthropometric width of the human head.

3. The method of claim 1, wherein each of the half-plane sections forms a polar angle with a frontal half plane oriented in a Y axis direction.

4. The method of claim 1, wherein the resulting geometric model of the human head has a generally ovular shape when viewed from a side after consideration of interpolation.

5. The method of claim 1, wherein each of the half-plane sections is formed using a rectangular shape coupled with a semi-circular shape.

6. The method of claim 5, wherein the rectangular shape has a width and a height, and the semi-circular shape has a radius, and wherein the radius of the semi-circular shape is equal to one-half of the width of the rectangular shape.

7. The method of claim 1, wherein each of the half-plane sections is formed using a isosceles trapezoidal shape coupled with a semi-circular shape.

8. The method of claim 7, wherein the isosceles trapezoidal shape has a width and a height, and the semi-circular shape has a radius, and wherein the radius of the semi-circular shape is greater than one-half of the width of the isosceles trapezoidal shape.

9. The method of claim 1, wherein the far-field shadowing filter accounts for the variability of the shape of the human head model.

10. The method of claim 1, wherein the near-field compensation filter is configured to account for large changes in interaural level difference as a virtual source approaches the human head, especially at low frequencies and for lateralized sources.

11. A method of modeling the human head, the human head having a width and an aspect ratio, the aspect ratio defining different head shapes independent of a size of the human head model, the method comprising the steps of:

forming a high-frequency head model based on ray-tracing and a plurality of half-plane sections;

coupling the high-frequency head model with a far-field shadowing filter; and coupling the far-field shadowing filter with a near-field compensation filter to compensate for acoustic changes between the far-field and near-field regions;

wherein the width of the model of the human head corresponds to an anthropometric width of the human head.

12. The method of claim 11, wherein human head model is variable from a nearly spherical to a very narrow embodiment.

13. The method of claim 11, wherein each of the half-plane sections forms a polar angle with a frontal half plane oriented in a Y axis direction.

14. The method of claim 11, wherein the resulting geometric model of the human head has a generally ovular shape when viewed from a side after consideration of interpolation.

15. The method of claim 11, wherein each of the half-plane sections is formed using a rectangular shape coupled with a semi-circular shape.

16. The method of claim 15, wherein the rectangular shape has a width and a height, and the semi-circular shape has a radius, and wherein the radius of the semi-circular shape is equal to ½ of the width of the rectangular shape.

17. The method of claim 11, wherein each of the half-plane sections is formed using a isosceles trapezoidal shape coupled with a semi-circular shape.

18. The method of claim 17, wherein the isosceles trapezoidal shape has a width and a height, and the semi-circular shape has a radius, and wherein the radius of the semi-circular shape is greater than one-half of the width of the isosceles trapezoidal shape.

19. The method of claim 11, wherein the far-field shadowing filter accounts for the variability of the shape of the human head model.

20. The method of claim 11, wherein the near-field compensation filter is configured to account for large changes in interaural level difference as a virtual source approaches the human head, especially at low frequencies and for lateralized sources.

* * * * *